United States Patent [19]

Rumble

[11] 3,938,665

[45] Feb. 17, 1976

[54] DISPLAY UNITS

[76] Inventor: Clive St. John Rumble, 47 Orchard Court, Portman Square, London W. 1, England

[22] Filed: Dec. 13, 1973

[21] Appl. No.: 427,029

[30] Foreign Application Priority Data

| | | |
|---|---|---|
| Dec. 18, 1972 | United Kingdom | 58321/72 |
| Feb. 7, 1973 | United Kingdom | 6110/73 |
| Sept. 7, 1973 | United Kingdom | 42215/73 |

[52] U.S. Cl. ..... 211/4; 211/40; 211/163

[51] Int. Cl.[2] ..... E05B 73/00

[58] Field of Search ..... 211/4, 7, 40, 42, 58, 64, 211/78, 115, 131, 163, 165, 166, 168; 312/11, 202, 252, 135; 206/387; 70/62

[56] References Cited

UNITED STATES PATENTS

| | | | |
|---|---|---|---|
| 923,647 | 6/1909 | Gullong | 211/58 |
| 938,809 | 11/1909 | Alexander et al. | 211/163 X |
| 1,757,600 | 5/1930 | Sprowle | 211/4 X |
| 2,926,788 | 3/1960 | Jacobson | 211/163 |
| 3,319,800 | 5/1967 | Bowles | 211/163 |
| 3,464,748 | 9/1969 | Gregory | 211/40 X |
| 3,674,156 | 7/1972 | Krebs | 211/4 |
| 3,692,376 | 9/1972 | McKinsey et al. | 312/11 |
| 3,760,952 | 9/1973 | White | 211/4 X |
| 3,785,499 | 1/1974 | Gedye | 211/4 |

FOREIGN PATENTS OR APPLICATIONS

| | | | |
|---|---|---|---|
| 475,770 | 11/1937 | United Kingdom | 211/163 |
| 925,070 | 2/1955 | Germany | 211/163 |
| 20,309 | 7/1900 | United Kingdom | 211/163 |
| 438,834 | 3/1912 | France | 211/144 |
| 1,184,880 | 2/1959 | France | 211/165 |
| 1,074,387 | 2/1960 | Germany | 211/42 |

*Primary Examiner*—Francis K. Zugel
*Assistant Examiner*—Thomas J. Holko

[57] ABSTRACT

The invention relates to a unit for displaying cassettes and tape cartridges. The unit is pivotally mounted about a fixed support and comprises one or more radially extending display sections each of which is adapted to receive the cassettes in a slidable manner in the radial direction from the ends of the arms forming the display section. Unauthorised removal of the cassettes is prevented by a locking device which may be positioned under the control of a locking mechanism across the plane of withdrawal of the cassette from the arms of each display section. The locking device may comprise a relatively rotatable frame incorporating locking bars. In an alternative arrangement a locking rod may be positioned in the arms for vertical or horizontal movement under the control of a locking mechanism. The locking rods may also be angularly movable.

2 Claims, 9 Drawing Figures

DISPLAY UNITS

This invention relates to units for displaying cassettes, tape cartridges and other similar flat articles such as books, records, etc. (hereinafter referred to generally as cassettes) for inspection, for example by customers in premises such as shops.

Hitherto, cassettes for sale have generally been openly displayed for examination by potential customers on counters or open display units. The present invention has as its main object the provision of an improved display unit, the construction of which enables cassettes to be stored for ready inspection as to their content, but which prevents the unauthorised removal of the cassettes from the unit by the customer. A further object is to provide such a display unit which is simple in construction and which provides also a considerable saving in space due to its improved design and method of mounting.

In its broadest aspect the invention comprises a display unit which is mounted about a vertical or horizontal axis and which is preferably, but not necessarily, angularly movable about said axis to enable cassettes carried by the display unit to be inspected by a customer.

In the preferred embodiment of the invention, the display unit comprises a base member having a vertically extending central rod mounted thereon for rotatably supporting a display frame comprising a plurality of arms extending horizontally in a radial manner therefrom. The arms are preferably formed with longitudinally extending flanges for receiving the cassettes in a slidable manner and the display unit is provided with a rotatable outer frame having vertically located members movable to abut the end of the shelf units so as to prevent unauthorised removal of the cassettes in a slidable manner from the ends of the shelf units.

The rotatable outer frame is provided with locking means and may be of any desired shape, such as circular or rectangular.

In a modified embodiment of the invention the rotatable outer locking frame is replaced by locking rods slidably engaging corresponding apertures in each vertical series of arms of the display frame. Each display unit is preferably provided with a base plate having an aperture therein for permitting removal of a selected locking rod. The aperture in the base plate is preferably provided with locking means to prevent the unauthorised removal of a locking rod from the corresponding display unit.

In yet another embodiment of the invention the locking rods are modified by providing each locking rod with a plurality of crimped sections, the rods being rotatable about their longitudinal axis so as to bring the crimped sections opposite the ends of the arms to prevent the unauthorised removal of cassettes therefrom. Preferably the locking rods are held in the locked position by means operable to allow selected rods to be released for rotation about their axis so as to pivot the crimped sections angularly away from the ends of the arms to allow removal of selected cassettes.

This modified arrangement is of particular use in premises where insufficient height is available for removing the rods vertically as in the previous embodiment.

In yet another modified embodiment of the invention the vertical locking rods are replaced by horizontal straps or bars carried by a frame slidably mounted over the outer ends of the arms of each display section. In the locked position of the movable frame the straps or bars are positioned to prevent the unauthorised removal of cassettes.

In order that the invention may be clearly understood the preferred embodiments of the invention will now be described by way of example with reference to the accompanying drawings, in which.

Figure 1:
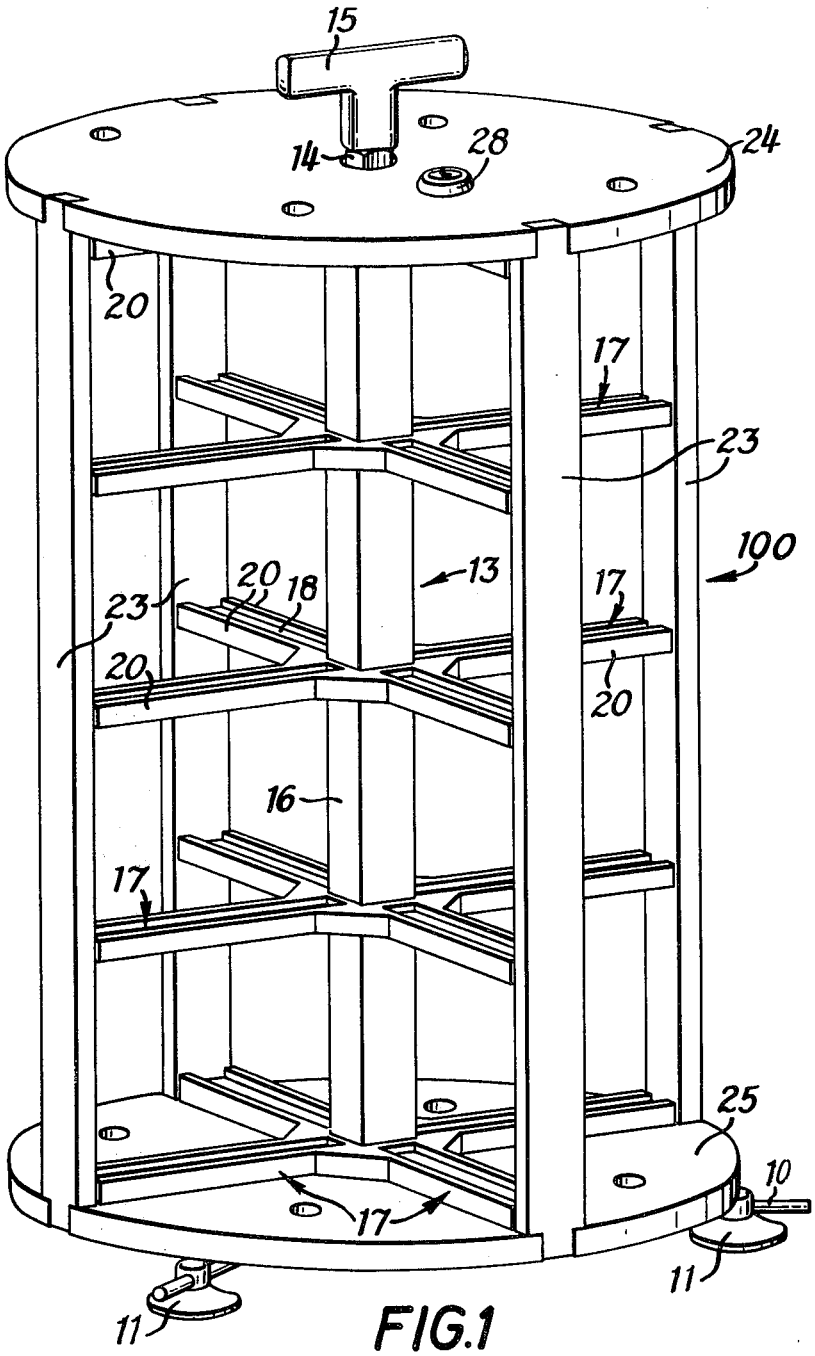
FIG. 1 is a perspective view of one embodiment of a display unit in accordance with the invention.
Figure 2:
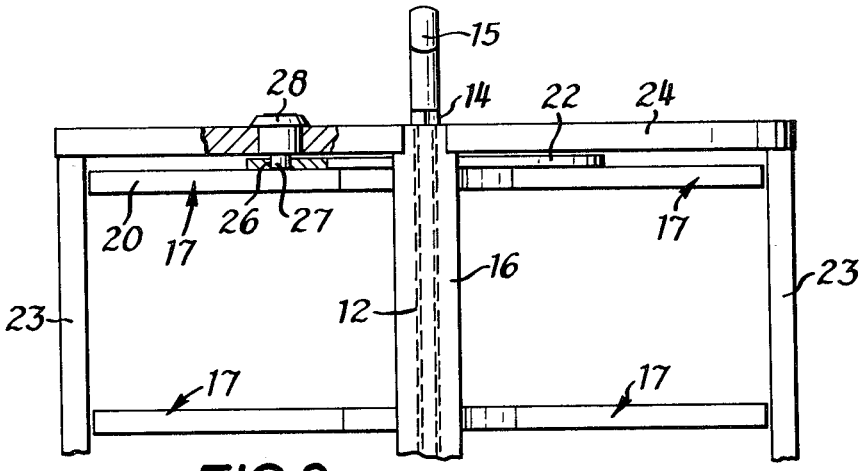
FIG. 2 is a part sectional view of the top section of the display unit of FIG. 1 showing the locking mechanism for preventing unauthorised removal of cassettes from the unit.

One embodiment of the invention is shown in FIGS. 1 and 2 of the drawings. This embodiment is adapted for mounting on a counter or other fixed structure so that the display unit can be inspected by a customer.

The display unit 100 comprises a base member (not shown) which may be of any desired configuration but which is preferably of circular cross-section. In order to provide for stability of the unit the base member may be relatively small in cross-section and is provided with a plurality of radially extending supporting legs 10 having adjustable supporting pads 11 thereon.

A display frame 13 is rotatably mounted on a vertically located rod 12 fixedly mounted centrally of the base member. The frame 13 is retained in position on the central rod of the base member by a lock nut 14 engaging a threaded portion of the rod 12 and the display unit is completed by a carrying handle 15 which threadably engages the top threaded portion of the rod 12 above the lock nut 14.

The display frame 13 is preferably circular in construction as shown, but it may have any desired shape, such as rectangular, to suit requirements.

The display frame 13 comprises two relatively movable sections which can be locked together as will be hereinafter described for rotation about the fixed central rod 12.

The first section of the display frame 13 comprises a central pillar 16 which is rotatably mounted on the central rod 12 and is preferably of rectangular, e.g. square cross-section. A plurality of display sections extend radially from each surface of the central pillar 16. Each display section is formed by a plurality of arms 17 which extend in a radial manner from the central pillar and which are vertically spaced along the pillar so that the distance between adjacent arms corresponds to the size of the cassettes to be displayed.

Figure 3:
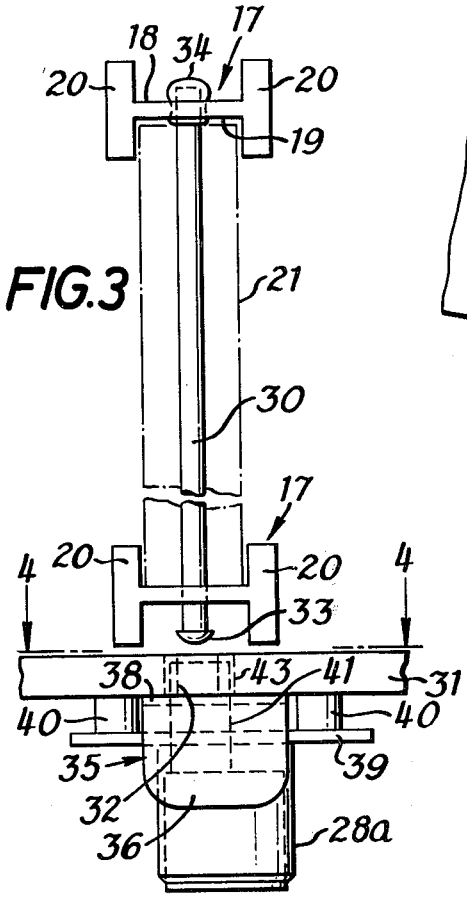
FIG. 3 is a part sectional view of the lower section of a modified embodiment of a display unit in accordance with the invention.

The construction of the arms 17 is shown more clearly in FIG. 3 of the drawings. The arms 17 have a top horizontal surface 18, a horizontal bottom surface 19 and side flanges 20 which extend both upwardly and downwardly from the surfaces 18 and 19. The arrangement is such that each display section comprises a vertical series of shelflike units for receiving cassettes in a slidable manner, the cassettes 21 engaging as shown in FIG. 3 between the flanges 20 of a pair of adjacent arms 17. If desired the distance between flange sections on opposite sides of the arms may be of varying width so that cassettes and other articles of different width can be displayed in the same section. The particular display unit shown in FIG. 1 comprises four display sections spaced 90° apart around the central pillar 16, each display section consisting of a vertical series of four display units. It will be understood that any number of display sections and display units can be provided.

The first section of the display frame 13 is preferably completed by a top plate 22 rigidly fixed to the pillar 16 and top arms 17 although in practice this plate is not necessary.

The second section of the display frame 13 comprises basically a locking frame for preventing unauthorised removal of cassettes from the display frame. The locking frame comprises a vertically extending bar 23 for each vertical display section, i.e. four bars are shown in the present embodiment. The locking bars 23 are rigidly connected between a pair of spaced plates 24, 25 which are preferably of circular construction but which may be of rectangular or other shape. The plates 24 and 25 are mounted on the central pillar 16 and are rotatable relatively thereto, the construction being such that when the locking frame is in a predetermined position the locking bars 23 are each located closely adjacent the outer ends of a vertical series of arms 17 to prevent removal of the cassettes positioned thereon.

In order to lock the bars 23 in position, locking means may be mounted on one or other of the plates 24, 25 for engaging the inner section of the display frame 13. Preferably the plate 22 is provided with one or more holes 26 for receiving the spigot 27 of a key operated locking mechanism 28 carried by the top plate 24, the locking mechanism 28 having a depressible barrel which is lockable to move the spigot 27 into one of the holes 26, which in this position retains the locking bars 23 adjacent the ends of the arms 17.

In the locked position of the mechanism 28, the complete display frame 13 is rotatable about the central rod 12 of the base member for inspection by a potential customer. After unlocking, the locking bar section can be rotated relatively to the inner section so as to permit the authorised removal of selected cassettes.

Figure 4:
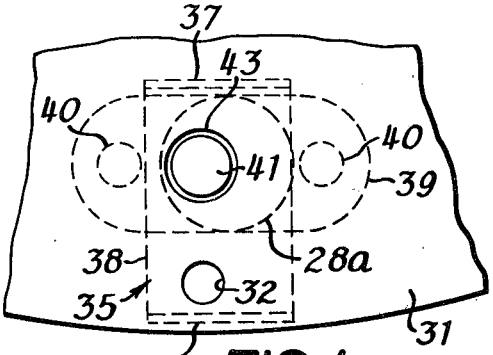
FIG. 4 is a plan view taken on the line 4—4 of FIG. 3.
Figure 5:
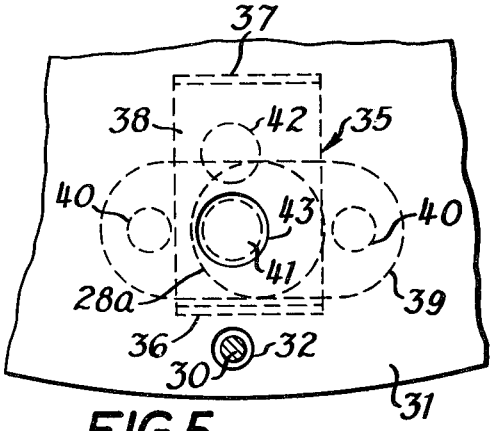
FIG. 5 is a plan view similar to FIG. 4 but showing the locking mechanism operated to allow the release of the locking rod.

The modified embodiment of the invention as shown in FIGS. 3 to 5 of the drawings provides an alternative locking arrangement in which the outer locking section of the display frame 13 is replaced by locking rods 30 slidably mounted in the ends of each vertical series of arms 17.

In this modified embodiment of the invention the outer locking frame of the previous embodiment is unnecessary and to support the display unit a support frame may be provided with legs for floor mounting or a short pedestal or other fitting for mounting the unit on a counter or on a wall. The support frame may comprise crossed members extending at right angles to each other and interconnected centrally to provide a support point for the central rod 12 of the unit.

The support frame for the unit includes a rigid base member or plate 31 fixedly located below the lowermost arms 17 of the display unit. Each rod 30 extends through holes 32 adjacent the ends of the corresponding series of vertically spaced arms 17, the rods being positioned intermediate the flanges 20 so as to prevent removal of the cassettes.

The rods 30 are selectively removable either upwardly or downwardly in the vertical direction to allow the removal of cassettes from a selected position in the display unit. In FIG. 3 the rod 30 is removable downwardly through the hole 32 in the base plate 31. To prevent upward movement the rods 30 are provided with an enlarged head 33 and when positioned the rods engage a bung or grommet 34 fitted in the top of the hole in the uppermost arm 17 of each vertical series of arms.

The single hole 32 in the base plate 31 is large enough to allow the passage therethrough of the head 33 but normally the hole 32 is blocked by a movable plate 35 under the control of a key operated locking mechanism 28*a*. The plate 35 is channel shaped having a front face 36 and a rear face 37, the intermediate face or base 38 being slidably supported beneath the base plate 31 by a plate 39 attached to the underside of the base plate 31 by spaced lugs 40. The key operated locking mechanism 36 is mounted on plate 39 and is operable to engage a locking spigot 41 with holes 42 and 43 in the plate 35 and base plate 31 respectively.

The locked position of the parts is shown in the plan view of FIG. 4. The withdrawal of the locking spigot 41 by operation of the locking mechanism 36 permits the radial sliding movement of the channel shaped plate 35 into the unlocked position as shown in the plan view of FIG. 5. In this position of the parts the selected locking rod can be withdrawn downwardly through the hole 32 to allow the removal of cassettes from the corresponding arms of the display unit.

Figure 6:
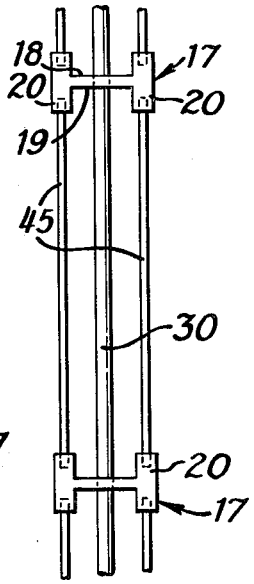
FIG. 6 is a part side view of a cassette receiving section showing the use of rods to provide greater rigidity.

In the embodiment of FIGS. 1 and 2 and the modified embodiment of FIGS. 3 to 5 the unauthorised removal of cassettes by the bending or flexing of the arms 17 can be prevented by providing rods or spacers fixedly mounted in the flanges 20 and extending between adjacent arms 17 closely adjacent the outer ends of the arms. The arrangement is shown in FIG. 6 where a rod 45 is positioned at each side of the cassette receiving space between the flanges 20 of the arms 17.

Figure 8:
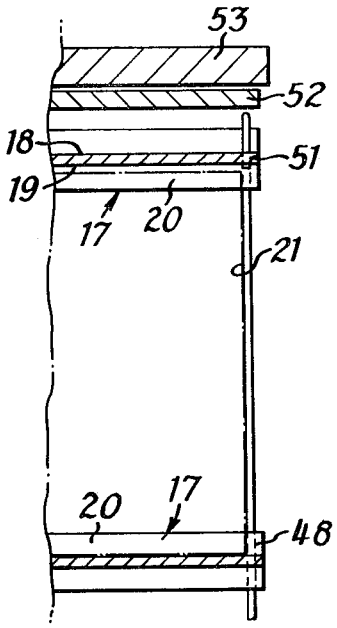
FIG. 8 is a part sectional side view of the embodiment of FIG. 7.
Figure 7:
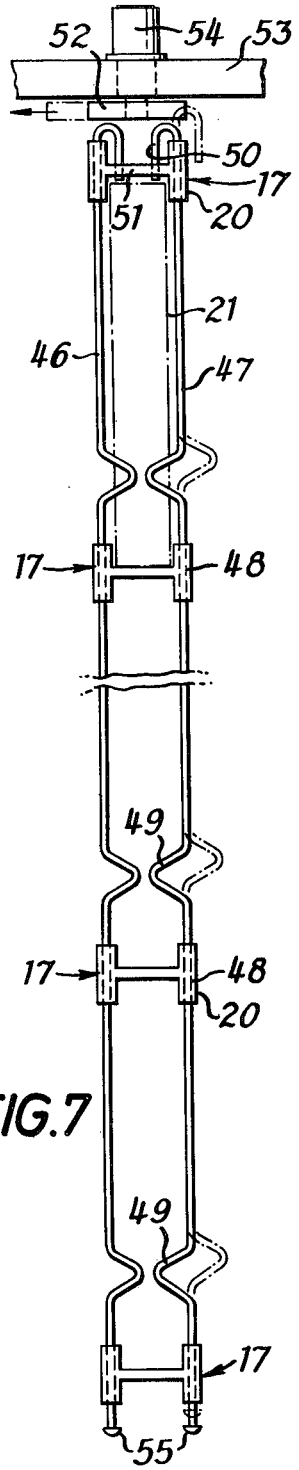
FIG. 7 is a side elevation of a further modified embodiment of a display unit in accordance with the invention in which the locking rods are rotated to allow removal of cassettes from the display unit.

In the modified embodiment of the invention as shown in FIGS. 7 and 8 of the drawings locking rods for preventing removal of the cassettes from arms 17 are provided as in the previous embodiment. Preferably two locking rods 46 and 47 are provided for each vertical series of arms 17, the rods being slidably located in holes 48 in the flanges 20 closely adjacent the ends of the arms 17.

Each pair of rods 46 and 47 is inserted in the holes 48 in the corresponding vertical series of arms 17, the holes being such as to allow easy rotation of the rods about their longitudinal axis. Each section of the rods between adjacent arms 17 is then crimped successively in situ so as to provide crimped or bent portions 49 projecting from the general line of the rods.

Basically unauthorised removal of the cassettes is prevented by positioning the rods 46 and 47 angularly so that the crimped sections 49 extend across the space between the arms 17 into the plane of withdrawal for the cassettes as shown in full lines in FIG. 7. In this position the locking rods are held against angular movement by turning over the top end of the rods to provide a bent-over section 50. Further holes 51 are provided in the top arm 17 of the unit for receiving the ends of the bent-over sections 50 of the locking rod so that when the bent-over sections 50 are located in the hole 51 rotation of the locking rods 46 and 47 is prevented.

The release of the locking rods 46 and 47 for angular rotation is obtained by first vertically moving the rods so as to remove the ends of the bent-over sections 50 from the holes 51 in the top arm 17 of the display unit. Thereafter, the rods can be rotated to project the crimped sections 49 away from the plane of withdrawal of the cassettes 21 as shown in chain lines in FIG. 7. Vertical movement of the rods is normally prevented, however, by a rotatable top member in the form of a spider 52 which can be held locked to a top plate 53 by a key-operated mechanism 54. Release of the spider 52 for rotation relatively to the top plate 53 allows vertical movement of the locking rods 46 and 47 as shown in chain lines in FIG. 7. As before, a bottom plate may be unnecessary for the display unit in that support for the locking rods 46 and 47 by means of such a plate is not necessary. The crimped sections 49 on the rods prevent their withdrawal from the display unit, but, if desired, an end stop 55 can be provided on the rods below the lowermost arm 17.

In the operative position the crimped sections 49 can be provided at any desired position between adjacent arms 17. Preferably, however, the crimped sections 49 are located as shown adjacent one of the arms so as to provide greater rigidity.

It will, of course, be understood that only one rotatable locking rod may be provided and that the other rod may be a fixed spacer rod corresponding to the rod 45 of FIG. 6.

The modified embodiment of FIGS. 7 and 8 has the advantage in that the locking rods do not have to be moved in the vertical direction to release the cassettes. This embodiment is, therefore, of considerable use where insufficient height is not available for using the previously described embodiment.

Figure 9:
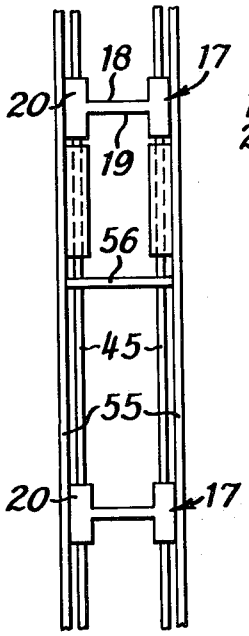
FIG. 9 is a part side view of a further modified embodiment of the invention.

In a modified arrangement shown in FIG. 9 the vertical locking rods are replaced by horizontal locking rods carried by a slidably movable frame. In the drawing the frame comprises spaced side members 55 slidably engaging the side faces of the arms 17 and interconnected by a plurality of horizontal bars or straps 56. The frame is slidably mounted on the fixed rods 45 between the arms 17 and is lockable as in the previous embodiments so as to position each strap or bar 56 across the plane of withdrawal of the cassettes between adjacent pairs of arms 17. In the unlocked position of the frame, the frame is movable in a vertical direction to position the straps or bars 56 opposite the arms 17 so as to allow the withdrawal of selected cassettes.

I claim:

1. A pilfer resistant display unit for displaying cassettes while permitting inspection of the faces thereof, comprising a base including a vertically extending support rod, a pillar member having a vertically directed central aperture rotatably mounted on said support rod, a plurality of angularly spaced apart sets of support arms extending radially from said pillar, each of said sets of support arms comprising an upper arm and a lower arm, said arms being vertically spaced apart in accordance with the vertical extent of said cassettes, the upper arm of each set including radially extending depending parallel flanges, and the lower arm of each set including upwardly extending parallel flanges, the upper and lower flanges of each set being disposed in coplanar alignment to define a channel having an outwardly open mouth through which said cassettes may be slidably received and removed in a radial direction, said flanges prohibiting substantial non-radial movements of a cassette mounted within a said channel, a locking frame mounted on said pillar for rotation relative thereto about a vertical axis, a plurality of vertically directed blocking arms formed on said frame, said blocking arms being shiftable between blocking and unblocking positions of said mouth portions of said channels selectively in accordance with the rotated position of said locking frame relative to said pillar member, and locking means extending between said pillar member and said locking frame for locking said blocking arms of said frame in said blocking position and releasing said arms to permit relative rotation of said locking frame and pillar respectively in the locked and unlocked positions of said locking means.

2. Apparatus in accordance with claim 1 wherein said locking frame includes an upper plate portion, and said pillar includes a locking plate in proximate spaced parallel relation to said upper plate portion, said locking means, in the locked position thereof, extending between said upper plate portion and said locking plate portion, thereby to prevent relative rotation of said parts.

* * * * *